US008074598B2

(12) United States Patent
Jones et al.

(10) Patent No.: US 8,074,598 B2
(45) Date of Patent: Dec. 13, 2011

(54) FLUID MANAGEMENT SYSTEM AND METHOD FOR FLUID DISPENSING AND COATING

(75) Inventors: Thomas B. Jones, Rochester, NY (US); Rajib Ahmed, Anderson, IN (US); Thomas N. Tombs, Rochester, NY (US)

(73) Assignees: Eastman Kodak Company, Rochester, NY (US); University of Rochester, Rochester, NY (US)

( * ) Notice: Subject to any disclaimer, the term of this patent is extended or adjusted under 35 U.S.C. 154(b) by 1160 days.

(21) Appl. No.: 11/565,027

(22) Filed: Nov. 30, 2006

(65) Prior Publication Data

US 2008/0131613 A1 Jun. 5, 2008

(51) Int. Cl.
*B05B 5/025* (2006.01)
*B05C 5/00* (2006.01)

(52) U.S. Cl. ..... 118/623; 118/638; 118/620

(58) Field of Classification Search ..... 118/620–638; 204/547, 643, 664, 164, 471–512, 622–626; 430/32, 103, 118.4; 399/241–245; 347/55
See application file for complete search history.

(56) References Cited

U.S. PATENT DOCUMENTS

| | | | | |
|---|---|---|---|---|
| 3,346,475 | A * | 10/1967 | Matkan et al. | 430/32 |
| 5,035,197 | A * | 7/1991 | Enoguchi et al. | 399/280 |
| 5,386,277 | A * | 1/1995 | Hays et al. | 399/281 |
| 6,368,696 | B1 | 4/2002 | Asahi et al. | |
| 6,888,721 | B1 | 5/2005 | Moghaddam et al. | |
| 6,899,137 | B2 | 5/2005 | Unger et al. | |
| 6,936,151 | B1 | 8/2005 | Lock et al. | |
| 6,949,176 | B2 | 9/2005 | Vacca et al. | |
| 7,081,192 | B1 * | 7/2006 | Wang et al. | 204/547 |
| 2004/0211659 | A1 * | 10/2004 | Velev | 204/164 |
| 2005/0092606 | A1 | 5/2005 | Reich et al. | |
| 2005/0226781 | A1 | 10/2005 | Yun et al. | |
| 2005/0253899 | A1 | 11/2005 | Ueda et al. | |

FOREIGN PATENT DOCUMENTS

| | | |
|---|---|---|
| JP | 10337524 | 12/1998 |
| WO | PCT/GB2004/002591 | 6/2004 |

OTHER PUBLICATIONS

Definintion of the word "fluid", Dictionary.com Unabridged,Random House, Inc. 2010.*
Thomas B. Jones, "DEP Microactuation and Droplet Dispensing", May/Jun. 2006, pp. 1-4.

(Continued)

*Primary Examiner* — Yewebdar Tadesse
(74) *Attorney, Agent, or Firm* — Donna P. Suchy; Christopher J. White

(57) ABSTRACT

A system and method are provided including a coating method and apparatus using a dielectrophoretic fluid movement system to coat with a non-conducting fluid along a surface that includes a non-conducting surface to receive the non-conducting fluid and a first and second array of one or more substantially parallel microelectrodes positioned on the surface, said first array having microelectrode(s) positioned between, and alternating with, the microelectrode(s) of the second array, forming an interleaved pattern as well as an electric power source in communication with the first array and second array so that the first array and second array interact to create a non-uniform electric field such that the non-conducting fluid moves parallel to the microelectrodes in response to the applied non-uniform electric field.

27 Claims, 14 Drawing Sheets

OTHER PUBLICATIONS

R. Ahmed and T. B. Jones, "Dispensing picoliter droplets on substrates using dielectrophoresis", from Journal of Electrostatics, pp. 1-7.
T. B. Jones, "An electromechanical interpretation of electrowetting", Apr. 1, 2005, pp. 1184-1187.
R. Ahmed, D. Hsu, C. Batey, and T. B. Jones, Dispensing Picoliter Droplets Using Dielectrophoretic (DEP) Micro-Actuation, pp. 1-8.
M. R. King and O. A. Lomakin, R. Ahmed and T. B. Jones, "Size-selective deposition of particles combining liquid and particulate dielectrophoresis", Feb. 8, 2005, pp. 1-7.
K. L. Wang and T. B. Jones, "Electrowetting Dynamis of Microfluidic Actuation", Mar. 23, 2005, pp. 4211-4217.
5th Inernational Electrowetting Meeting, May 31, 2006-Jun. 2, 2006 and presentation slides, pp. 1-12.

* cited by examiner t=0 t=1.94s t=2.36s t=2.64s t=2.95s t=4.02s t=5.23s

FLUID MANAGEMENT SYSTEM AND METHOD FOR FLUID DISPENSING AND COATING

FIELD OF THE INVENTION

The invention relates generally to the fields of coating and printing, and more particularly to processes and apparatus for enhancing digital color reproduction systems.

BACKGROUND OF THE INVENTION

It is desirable to be able to coat discrete areas of a flexible support in a continuous roll-to-roll manner, to enable the fabrication of flexible electronics, micro lens arrays or display devices, etc. There are a variety of existing techniques based on printing technology, such as flexography, offset and screen printing, currently available to meet this desire, although generally the coating generated by such techniques is not controllable in a way that allows spatial or temporal changes in coating thickness that can be continuously modified.

The use of differential wettability to pattern the support prior to overcoating with the target liquid in a continuous manner—termed continuous discrete coating (CDC)—has been demonstrated in PCT/GB2004/002591. The CDC method allows the use of existing coating hardware to pattern layers but this method relies on a predetermined surface pattern to control the coating thickness and cannot affect coating thickness in a variable way (the coating is either present or absent) nor does the process allow the coating thickness and placement to be continuously controllable. PCT/GB2004/002591 discloses the CDC technique. U.S. Pat. No. 6,368,696 describes a method of depositing multiple layers and subsequently patterning the dried multilayer pack with an additional step, for the manufacture of plasma display panels. JP10337524A discloses a method to manufacture dielectric/electrode panels.

Also desirable is a method to electrically control the movement of small quantities of liquid across a surface. Existing methods employ barriers, airflow, or gravity.

In an electrophotographic modular printing machine of known type, for example, the Eastman Kodak NexPress 2100 printer manufactured by Eastman Kodak, Inc., of Rochester, N.Y., color toner images are made sequentially in a plurality of color imaging modules arranged in tandem, and the toner images are successively electrostatically transferred to a receiver member adhered to a transport web moving through the modules. Commercial machines of this type typically employ intermediate transfer members for the transfer to the receiver member of individual color separation toner images.

Sometimes electrophotographic copiers and printers use a release agent to prevent paper sheets from sticking to the fuser roll after transferred images have been heat fused. Dispensing this oil, typically silicone oil, onto the fuser roller using a blade, roller, or other mechanical means in a controllable manner is complicated by the highly wetting nature of the oil. Oil is only required in image areas (areas containing toner) to affect release of the toner from the heated fuser roller. However oil is typically applied across the entire surface of the fuser roller because there is no means to readily control the application of the oil. Broad application of oil in this manner often causes image artifacts because the oil tends to contaminate sensitive components when the printed media is sent back through the imaging unit to receive an image on the media's rear surface. A means to precisely control the application of highly wetting liquids such as silicone oil is needed.

Especially needed is continuous control, both temporally and spatially, of the quantity (or thickness) of such liquids.

SUMMARY OF THE INVENTION

In accordance with an object of the invention, a system and a method are provided for coating surfaces wherein real-time, temporal and spatial control of a coating material is achieved. The present invention overcomes shortcomings noted above by using voltage-controlled microfluidic structures and hydrophobic surface treatments to controllably dispense a fluid across a surface.

More specifically, the invention relates to a coating method and apparatus using a dielectrophoretic fluid management system that dispenses non-conducting fluid from a non-conducting substrate patterned with a first and second array of one or more substantially parallel microelectrodes, said first array having microelectrode(s) positioned between, and alternating with, the microelectrode(s) of the second array and forming an interleaved pattern. The system uses an electric power source in communication with the first array and second array so that the first array and second array interact to create a non-uniform electric field such that the non-conducting fluid moves parallel to the microelectrodes in response to the applied non-uniform electric field. In one embodiment of this method the surface and microelectrodes are coated with a material such that the contact angle of the non-conducting liquid is greater than 10 degrees and the voltage to the electrodes is controlled to stop and start fluid movement.

A second object of the invention is a system and a method for improving the image quality and reliability of printing systems, and specifically the efficiency and accuracy of the application of fluid needed in the electrostatographic process. The invention is in the field of color reproduction printing systems, which include digital front-end processors, color printers and post-finishing systems such as UV coater, glosser, laminator, and etc.

While the specification concludes with claims particularly pointing out and distinctly claiming the subject matter of the present invention, it is believed the invention will be better understood from the following detailed description when taken in conjunction with the accompanying drawings.

BRIEF DESCRIPTION OF THE DRAWINGS

For a better understanding of the characteristics of this invention, the invention will now be described in detail with reference to the accompanying drawings, wherein:

FIG. 2*a* is a schematic illustration of the dielectrophoretic force on a liquid in an electric field created by applying voltage to electrodes. FIG. 2*b* illustrates how the liquid conforms to the electric field lines.

DETAILED DESCRIPTION OF THE INVENTION

The present description will be directed in particular to elements forming part of, or cooperating more directly with, apparatus and methods in accordance with the present invention. It is to be understood that elements not specifically shown or described may take various forms well known to those skilled in the art.

Figure 1A:
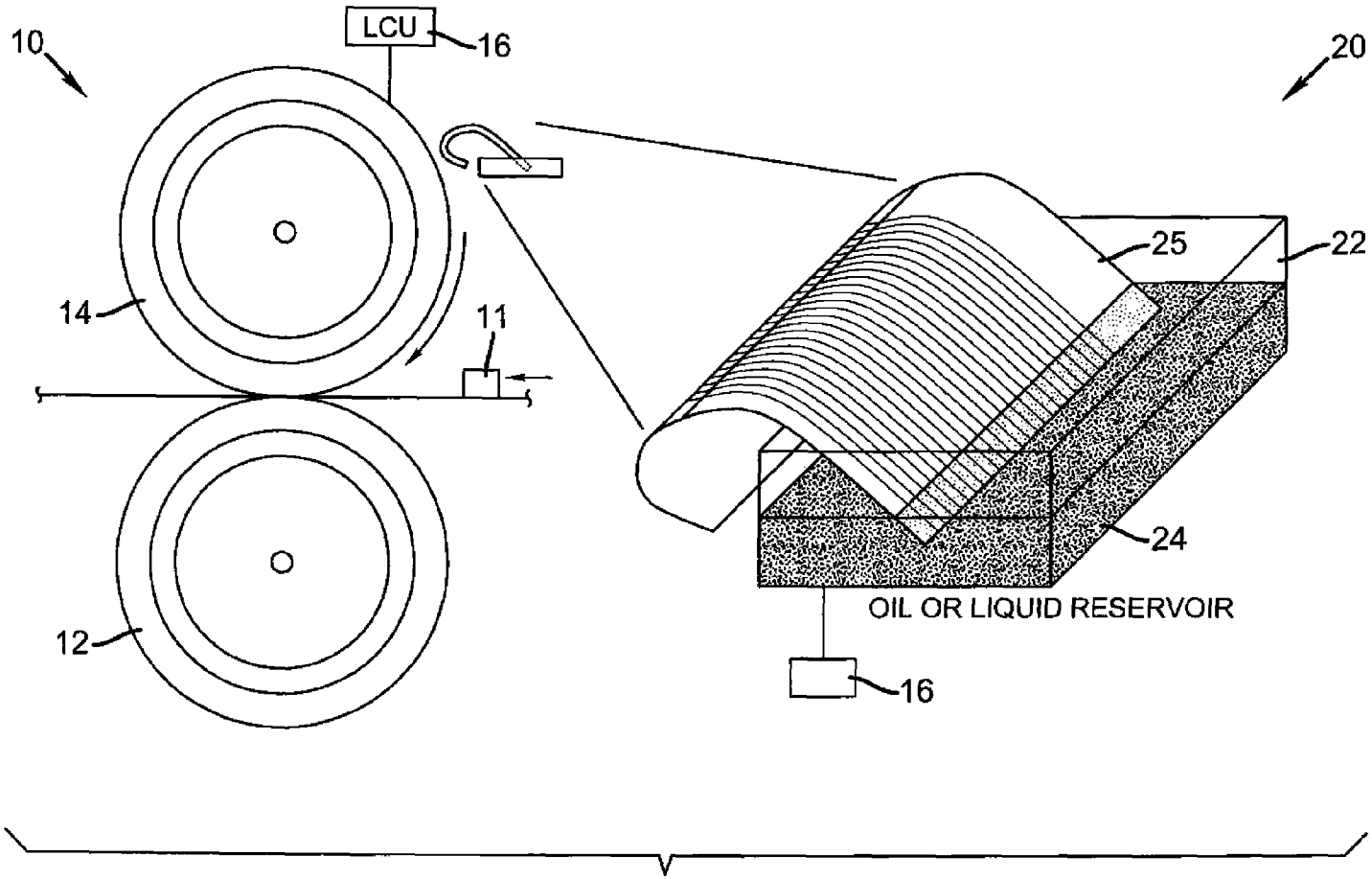
FIG. 1*a* is a schematic illustration of a portion of a printer system according to the present invention for use in conjunction with an image control system and method.

FIG. 1*a* shows schematically a portion of a printing system 10, such as an electrophotographic printer or other printing devices, hereafter referred to as simply printers but not limited to the traditional printer but also including plate production devices, and copiers that can print on a receiver 11, such as paper, metal, press sheets, cloth, ceramics and substrates that are printable. Electrophotographic printers are well known in the art, and are preferred in many applications; alternatively, other known types of printing systems may be used. Plural writer interfaces and development stations may be provided for developing images in plural colors, or from marking particles of different physical characteristics. Full process color electrophotographic printing is accomplished by utilizing this process for each of four, five or more marking particle colors (e.g., black, cyan, magenta, yellow, and clear).

The portion of a printer 10 shown includes a pressure roller 12 and a fuser roller 14, as well as a controller or logic and control unit (LCU) 16, preferably a digital computer or microprocessor operating according to a stored program for overall control of the printer and its various subsystems. The Logic and Control Unit (LCU) 16 is preferably a digital computer or microprocessor operating according to a stored program for sequentially actuating the workstations within the printer, affecting overall control of the printer and its various subsystems. Aspects of process control are described in U.S. Pat. No. 6,121,986 incorporated herein by this reference.

The LCU 16 includes a microprocessor and suitable tables and control software which is executable by the LCU 16. The control software is preferably stored in memory associated with the LCU 16. Sensors associated with the fusing and glossing assemblies, as well as other image quality features, provide appropriate signals to the LCU 16. In any event, the LCU 16 issues command and control signals that adjust all aspects of the image that affect image quality, such as the heat and/or pressure within fusing nip (not shown) so as to reduce image artifacts which are attributable to and/or are the result of release fluid disposed upon and/or impregnating a receiver member. Additional elements provided for control will be described below and include a power supply as well as liquid control and release mechanisms.

Printing systems, such as the NexPress 2100 family of high-speed digital production color presses made by Eastman Kodak, Inc. of Rochester, use a very thin layer of oil applied to the heated fuser roller to detack individual sheets after the toner images have been fixed on the paper. The amount of oil consumed is typically less than 10 microliters per sheet for a machine printing 70 copies per minute. The silicone-based oil is applied to the fuser roller continuously using a roller. A problem with the system is that the oil has a very low contact angle with most surfaces and tends to wet virtually everything so that, over time, oil contaminates other components in the machine. The contamination results from the need to print on both sides of paper. The fuser oil on the paper from the first pass gets transferred to the sensitive components in the printing engine when printing the second side of the page. This oil contamination increases maintenance costs while reducing image quality and the life of machine components. The coating system 20 described below is an effective means to control fuser oil dispensing, This control lowers the oil consumption and minimizes the application of oil in unwanted areas thus reducing contamination problems.

Figure 1B:
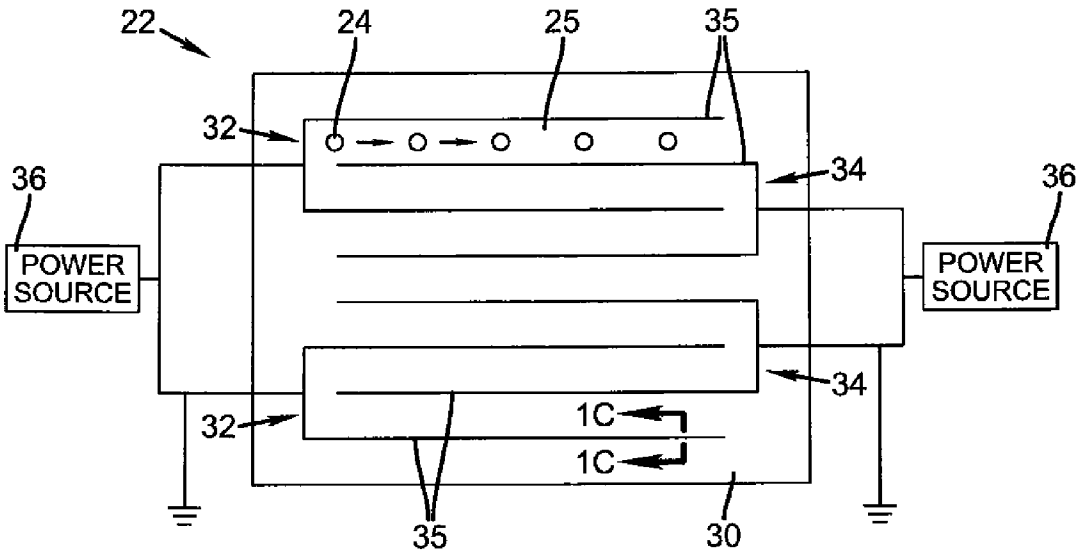
FIG. 1*b* is a schematic illustration of a fluid movement system according to the present invention for use in conjunction with a print engine or printer apparatus.

The coating systems 20, shown in FIGS. 1*a*, 1*b*, and l*c* for an electrophotographic printer is a voltage-actuated microfluidic structure 22 exploiting the liquid dielectrophoretic (DEP) force exerted on dielectric liquids 24 by a non-uniform electric field 25. The new system offers a means to control liquid flow to the fuser roller 14 in real time. The control of the power source by the LCU 16 offers the option of using feedback and/or feed forward to achieve optimized dispensing of the fluid, which is preferably an oil in this embodiment, such as silicon oil. A preferred embodiment of a geometrically simple and easy to fabricate electrode structure that can be used is shown in FIG. 1*b* and may be amenable to implementation in a retrofit kit designed for installation in existing machines. A portion of the coating system 20 for moving non-conducting fluid along a surface is shown in FIG. 1*b* and includes a non-conducting surface 30, which may be planar or curved, to receive the non-conducting fluid 24 and also includes the voltage-actuated microfluidic structure 22. The voltage-actuated microfluidic structure 22 includes a first array 32 and second array 34 of substantially parallel microelectrodes 35, shown here as positioned essentially flat with the top of a surface, said first array 32 having microelectrode(s) positioned between, and alternating with, the microelectrode(s) of the second array 34. forming an interleaved pattern. An electric power source 36 is in communication with the first array 32 and second array 34 so that the first array and second array interact to create a non-uniform electric field 25 such that the non-conducting fluid 24 moves parallel to the microelectrodes 35 in response to the applied non-uniform electric field 25. The microelectrodes 35 are spaced at a distance less than 0.1 mm and preferably have a non-conducting coating 38.

Figure 1C:
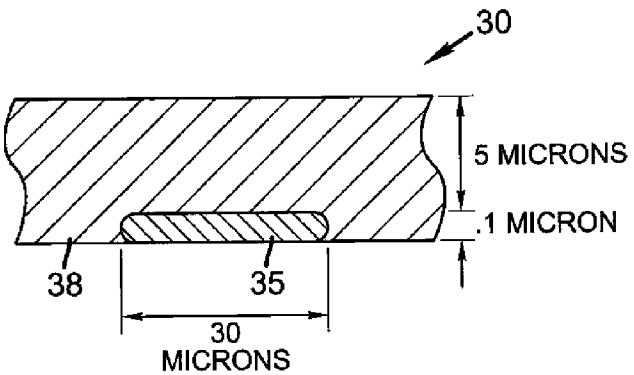
FIG. 1*c* is a cross section of the microelectrode.

FIG. 1*c* shows one embodiment where the micro electrode has a thickness of 0.1 micron, a width of 30 micron and is coated with 5 micron of insulating material.

In a preferred embodiment the coating system 20 moves the non-conducting fluid 25 along the non-conducting surface 30 using the microfluidic structure 22, where the microelectrodes are less than 1 mm in width and are spaced less than 0.1 mm apart and more preferably between 60 and 90 micrometers apart. The microelectrodes of the first array 32 are positioned between, and alternating with, the microelectrode(s) of the second arrays 34 to form an interleaved pattern as shown in FIG. 1*b*. The microelectrodes and the surface of this embodiment are covered with a non-conducting coating that ensures a contact angle between the surface and the non-conducting liquid of greater than 10 degrees. In this embodiment the electric power source 36 is in communication with the first array 32 and second array 34 such that the first array and second array interact to create a non-uniform electric field such that the non-conducting fluid moves parallel to the microelectrodes as will be discussed in more detail below. In one preferred embodiment of the coating system 20, the ratio between the electrode spacing and an electrode width is between 2:1 and 3:1 and the dielectric breakdown strength of the non-conducting coating 38 is greater then 50 Volts/micron. The non-conducting fluid can be a polymer that is at an elevated temperature and hardens when cooled such as a thermoplastic. The non-conducting fluid can also be a polymer dissolved in a solvent that hardens when the solvent is removed. Additionally the non-conducting fluid may include dye or particles. The non-conducting liquid preferably has a volume resistivity greater than $1\times10^{13}$ ohm-cm.

The described coating system 20 can be broadly used for the dispensing of other insulating liquids in many industrial processes ranging from roll and web coating to application of adhesives and possibly to critical microfabrication operations where thin layers must be laid down on large-area substrates.

The controlled flow of dielectric liquids can be achieved by a non-uniform electric field produced by properly designed electrodes. Early experiments with structures having dimensions of ~1 millimeter required voltages in excess of 20 kV that necessitated a high-pressure nitrogen gas environment to avoid electrical breakdown [T. B. Jones, M. P. Perry, and J. R. Melcher, "Dielectric siphons", *Science*, vol. 174, pp. 1232-1233, Dec. 17, 1971; T. B. Jones and J. R. Melcher, "Dynamics of electromechanical flow structures", *Physics of Fluids*, vol. 16, pp. 393-400, March 1973]. It has been found that reducing electrode dimensions to less than 0.1 millimeters invokes favorable scaling relations that drastically reduce the voltage requirement, avoid air breakdown, and create the opportunity for electric-field-coupled microfluidics.

Dielectrophoretic Liquid Control

Figure 2A:
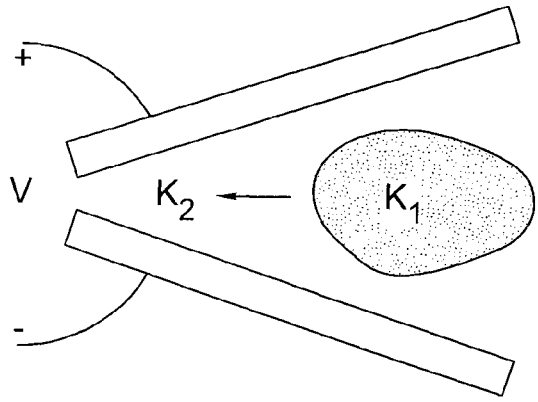
FIGS. 2*a*, 2*b* and 2*c* show the phenomenology of liquid dielectrophoresis.
Figure 2B:
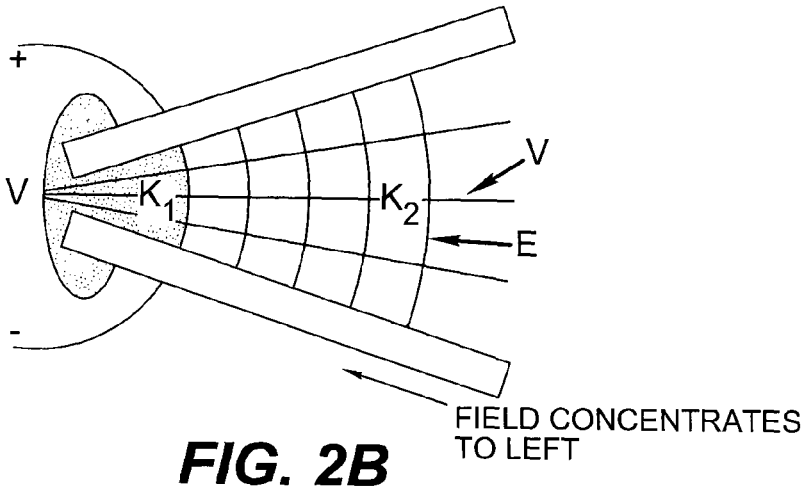
Figure 2C:
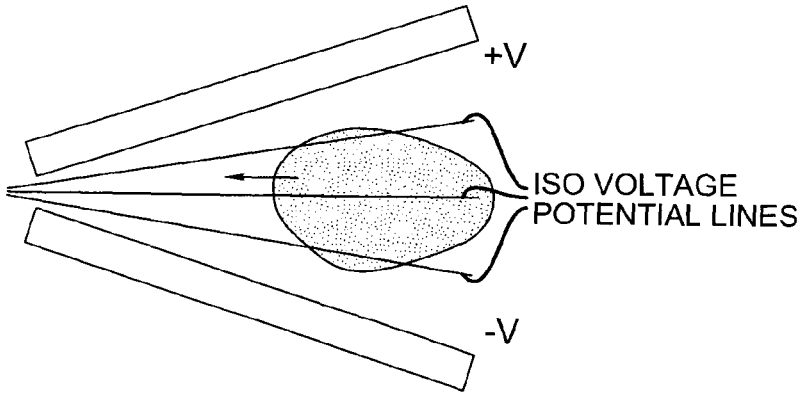

Dielectrophoresis (DEP) is an example of the classical ponderomotive effect, that is, the force exerted on dipoles by a non-uniform electric field. The dipoles—individual molecules in the case of a liquid—tend to collect in regions of higher electric field intensity as shown in FIGS. 2*a*, 2*b* and 2*c*. FIG. 2*a* shows the critical phenomenology of liquid dielectrophoresis (DEP) where a liquid of dielectric constant $K_1>K_2$ is drawn into a region of strong electric field. In FIG. 2*b* the dielectric liquid surface conforms to the electric field lines where E=F/q or qE=F. FIG. 2*c* shows the isovoltage potential lines in one example. This same force repels gas or vapor bubbles within this liquid from strong field region. Ordinarily, the preferred equilibrium of the collected liquid fixes the liquid surface to be parallel with the electric field lines, as depicted in FIG. 2*b*. This same force repels gas or vapor bubbles within this liquid from strong field region. Ordinarily, the preferred equilibrium of the collected liquid fixes the liquid surface to be parallel with the electric field lines, as depicted in FIG. 2*b*.

///Liquid DEP differs from other electrohydrodynamic (EHD) phenomena used in microfluidics in that it does not act as a conventional pumping mechanism where a pressure differential initiates the flow. Instead, the non-uniform electric field created by the electrodes establishes a new hydrostatic equilibrium to which the liquid responds when voltage is applied. Once the equilibrium is reached, the flow ceases unless fluid is continuously removed from the structure by some means. This hydrostatic equilibrium is best exemplified by Pellat's classic experiment, consisting of two plane, parallel electrodes at spacing D, oriented vertically and partially immersed in a pool of dielectric liquid of mass density ρ, and dielectric constant, κ. Gas of negligible density and polarizability approximately equal to free space, $\epsilon_o=8.854\times10^{-12}$ F/m, covers the liquid. For an applied voltage V, the liquid rises between the electrodes to a static height $$h_{DEP} = \frac{\varepsilon_o(\kappa-1)E^2}{2\rho g} \quad (1)$$

where E≈V/D estimates the uniform electric field between the electrode plates, and g=9.81 m/s$^2$ is the terrestrial acceleration due to gravity but ignoring any contribution due to_fringe fields. Also note that $h_{DEP}$ is proportional to the product of the difference in dielectric constants of the liquid and the gas, that is, (κ−1) and the square of the electric field, E.

Liquid dielectrophoresis can be implemented to initiate bulk electromechanical flow of insulating liquids. Such a method of liquid transportation has potential applications in controlling both spatial and temporal flow with high precision. The flow of liquid becomes a critical factor in various applications where volume flow control is required. Such a method can be instrumental in thin film coating on various substrates that require conformal and uniform coverage.

Figure 3A:
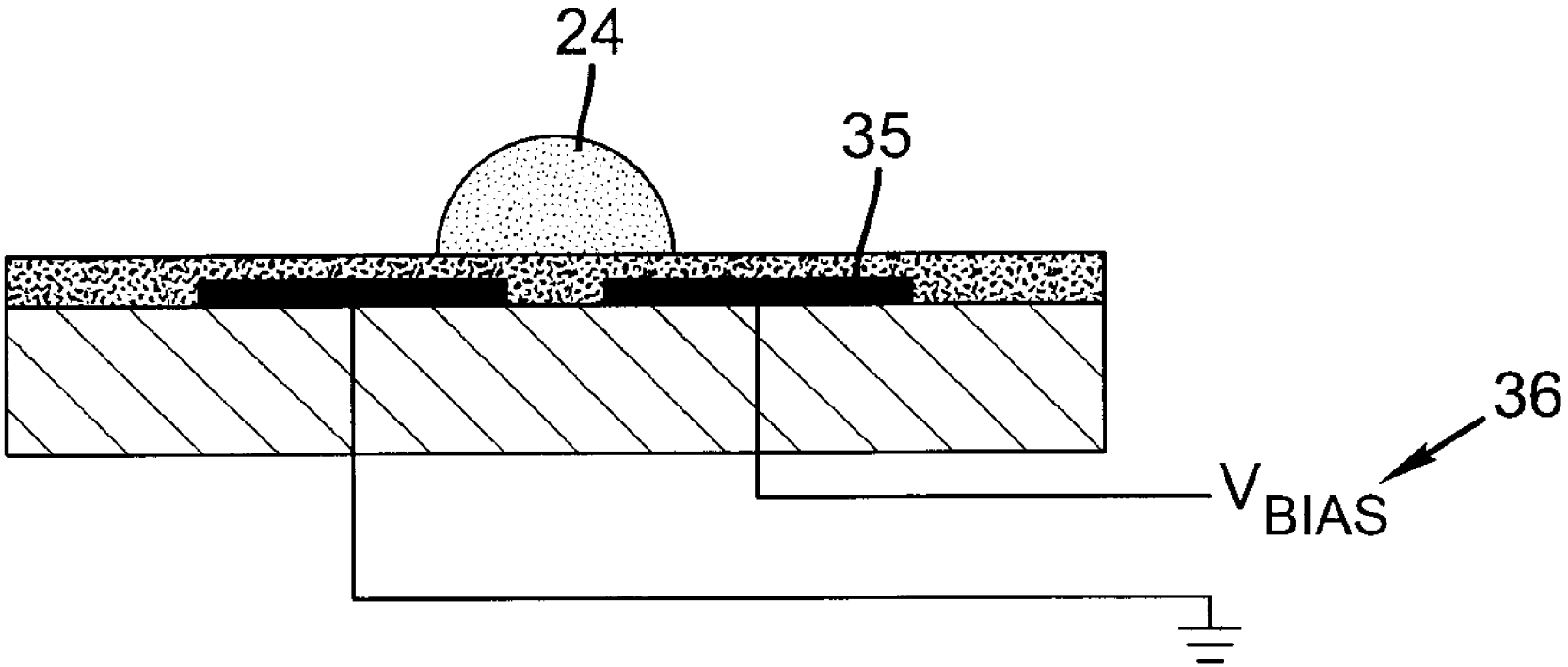
FIGS. 3*a*, 3*b* and 3*c* are schematic illustrations of representative portions of FIG. 1*a* showing additional details.
Figure 3B:
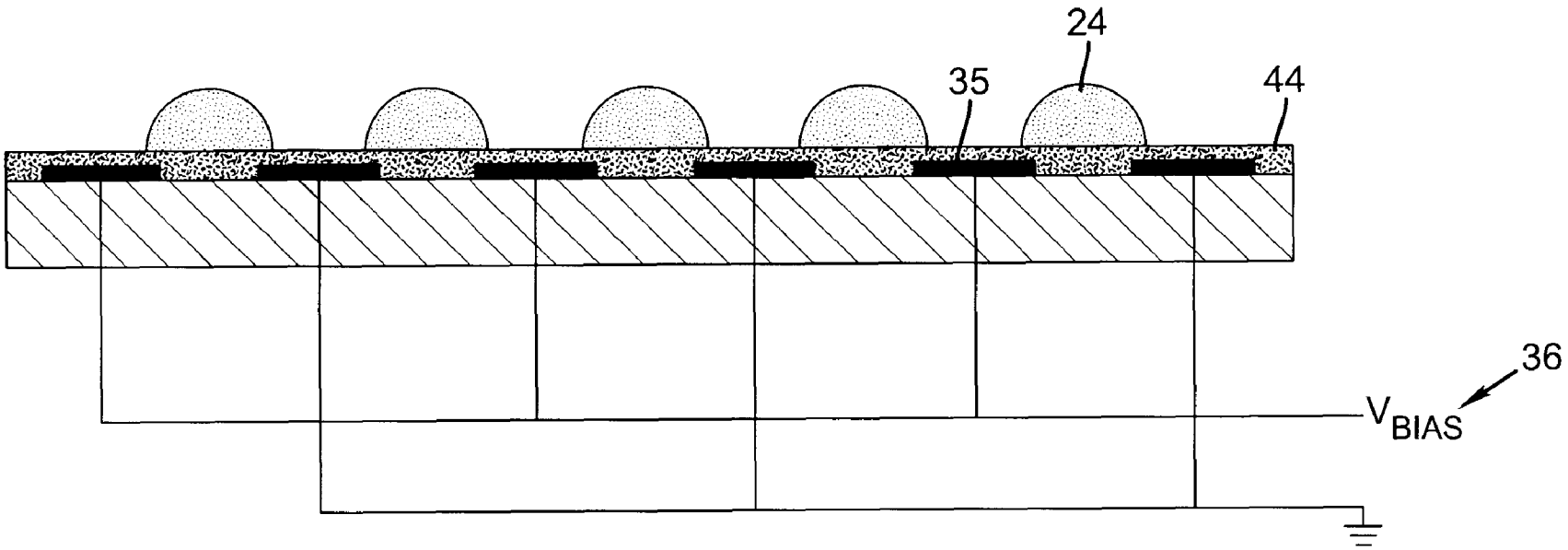

One realization of a liquid DEP flow structure is the simple coplanar scheme shown in FIG. 3*a*. for a dielectric flow structure for dielectric liquids with a liquid rivulet and a dielectric coating on the coplanar structure. This geometry has been used to dispense droplets of conductive, aqueous liquids ranging from ~10 picoliters to ~100 nanoliters see R. Ahmed and T. B. Jones, "*Dispensing picoliter droplets on substrates using dielectrophoresis," Journal of Electrostatics,* vol. 64, pp. 543-549, 2006. When voltage is turned on, the electric field causes a liquid finger (rivulet) to emerge from the parent droplet and move rapidly along the electrodes. The rivulet flows to the end of the structure where it stops. FIG. 3*b* shows the rivulet in cross-section, for fuser oil dispensing to rolls and/or webs. To provide the required mechanical flexibility for a wiper structure. The substrate is a flexible material such as a polyimide which is maintained by the electric field in a roughly semi-circular profile. DEP liquid actuation is not a true pumping mechanism; rather, it is analogous to capillarity; however, when the voltage is on, the DEP force easily overwhelms both capillarity and gravity. If voltage is then removed, the well-known capillary instability ensues, rapidly breaking up the static liquid rivulet into droplets.

Figure 3C:
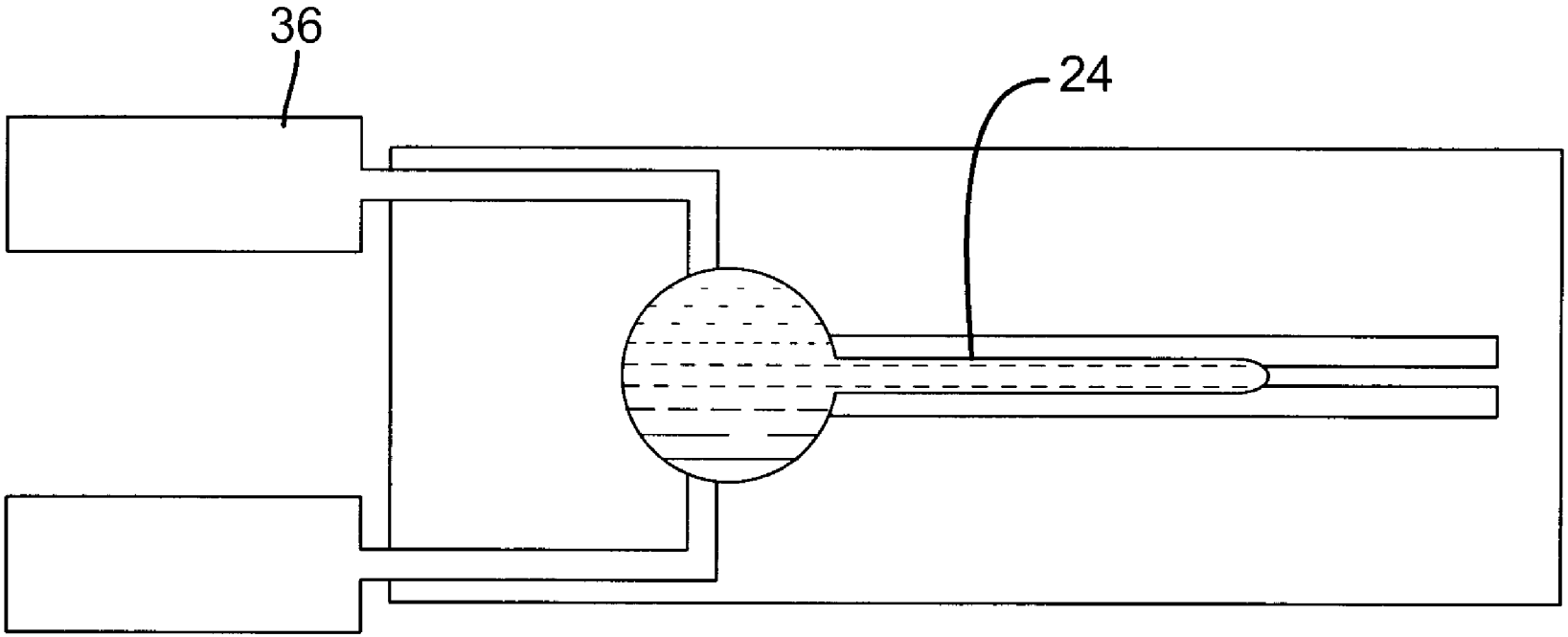
Figure 4A:
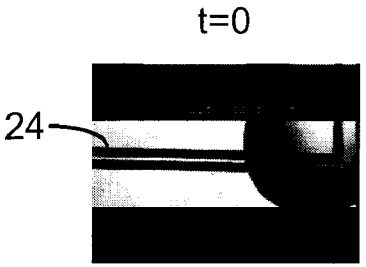
FIGS. 4-6 show the results of using the fluid movement system according to one aspect of the invention.
Figure 4B:
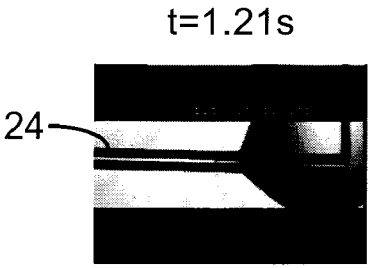
Figure 4C:
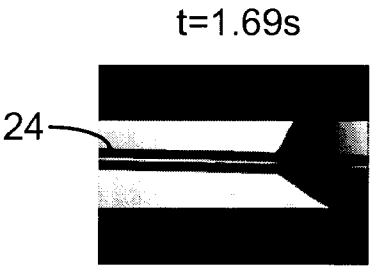
Figure 4D:
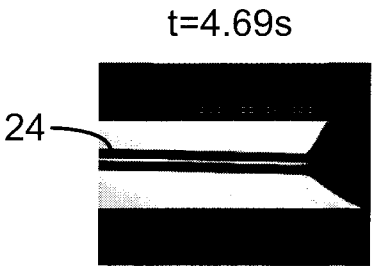
Figure 5A:
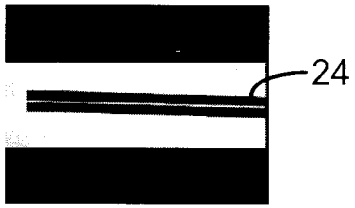
Figure 5B:
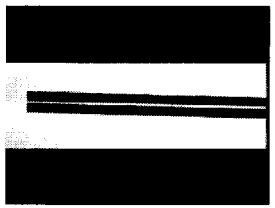
Figure 5C:
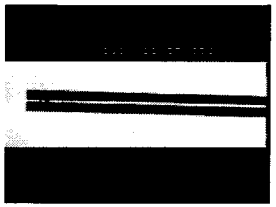
Figure 5D:
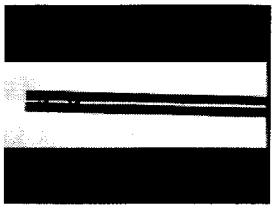
Figure 5E:
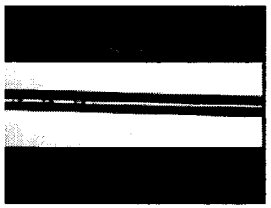
Figure 5F:
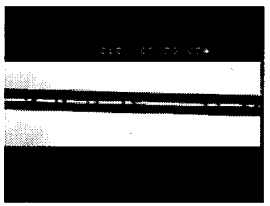
Figure 5G:
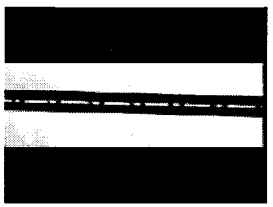
Figure 6B:
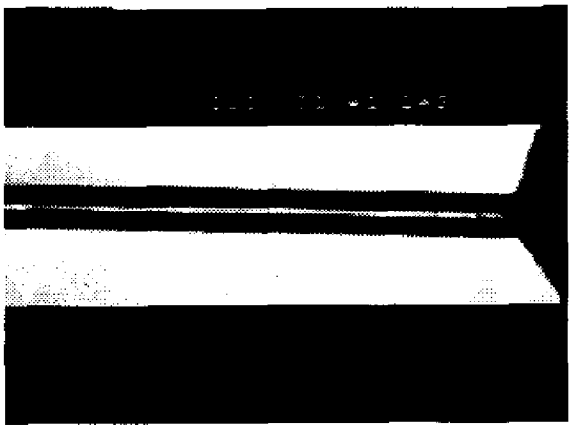
Figure 6A:
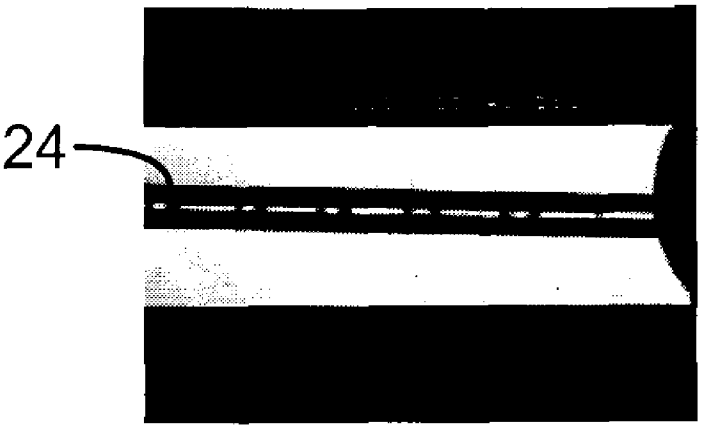

The electrodes, as shown in of FIG. 3*c,* in a schematic representation of the co-planer electrode structure, can be used to control the flow of insulating liquids. The long hoizontal lines are the electrodes and the solid blocks represent connection pads for voltage application. The gray region depicts the dielectric layer coating to control the oliophobic nature of the electrode surface. Because the dielectric constant of most such liquids is much lower than water, required voltages are higher. At the same time, the purely capacitive current requirement remains quite low, power consumption is minimal, and low-frequency square wave excitation can be used to minimize the risk of electrical breakdown. Experiments used a 1-10 μl droplet of silicon oil with viscosity from 350-3 cSt. At the T-junction. FIGS. 4, 5, and 6 demonstrate the operational principles of flow control. FIG. 4 shows selected video frames of the flow in an isolated, coplanar electrode structure consisting of two parallel electrode strips patterned in evaporated aluminum metal and coated with a few microns of Cytop™, a commercially available hydrophobic coating material. This was performed using 625 V-rms and 50 cSt fuser oil Due to wetting behavior, initial actuation is slow; however, the natural behavior of the liquid finger can be exploited to achieve rapid turn-on and turn-off flow control once the flow structure has been initially primed. Refer to FIG. 5 showing the behavior of the rivulet when voltage is removed. This was performed using 625 V-rms and 50 cSt fuser oil. FIG. 5 shows rivulet breakup into regularly spaced droplets at various times after the voltage has been removed. The camera paned from left to right starting in frame 'e'. Within seconds, the capillary instability breaks up the rivulet into droplets, thus severing liquid communication and cutting off the flow. With proper design of the electrodes to promote initiation of the capillary instability, the response time of the structure for stopping the flow of oil is adequate for fuser oil dispensing. If droplets already have been formed along the structure, reapplying voltage rapidly re-establishes the rivulet and the flow. The video frames in FIG. 6 show rapid re-establishment of liquid communication starting from an array of sessile droplets along the length of the structure after the voltage is reapplied and when the voltage is increased the response time rapidly decreases. By properly combining electrode geometries with hydrophobic and hydrophilic patterning of the surface to create distributed liquid reservoirs, excellent on/off control is achieved.

This microfluidic system can be used to control and dispense fuser oils and other fluids based on the interplay between electrical and capillary forces. DEP actuation is voltage-controlled, but both proper design of the electrodes and choice of materials having appropriate wetting properties are critical for effective control of flow rate and response time. Voltage can be used to control the viscous-limited volumetric flow rate because the cross-section of the electric-field-mediated rivulet, dependent on the voltage, determines the effective hydraulic diameter.

Figure 7:
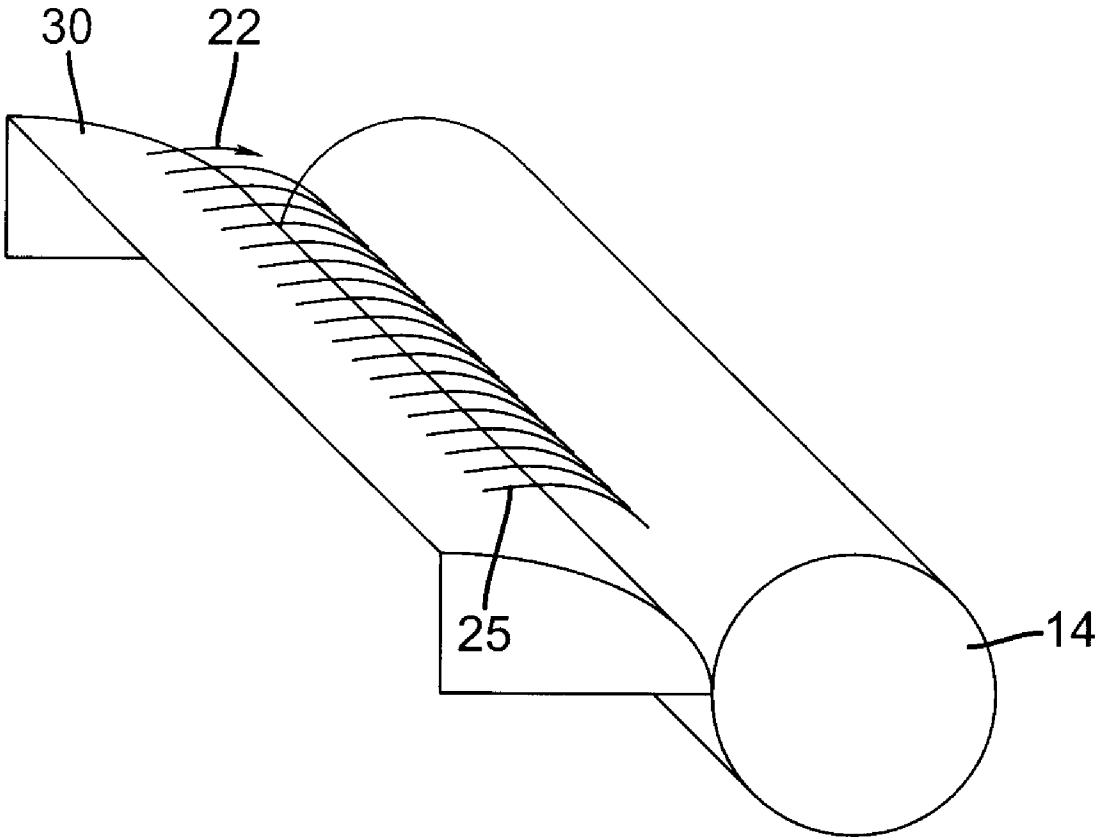
FIG. 7 relates to one embodiment of the invention.

FIG. 7 shows a coating method used for moving non-conducting fluid 24 along a flexible curved surface 30, the method comprising the steps of applying a non-conducting fluid to the non-conducting surface 30 including the first and second array of one or more substantially parallel microelectrodes 25 positioned on said surface, said first array having microelectrode(s) positioned between, and alternating with, the microelectrode(s) of the second array, forming an interleaved pattern so that the applied electric power to the first array and second array is such that the first array and second array interact to create a non-uniform electric field that moves the non-conducting fluid parallel to the microelectrodes 35 in response to the applied non-uniform electric field.

In the fuser oil application envisioned, the electrode structure will consist of hundreds or thousands of parallel electrode pairs at least 1 cm long. The coplanar electrode structures, in any of several designs, create a 2D electrostatic field when excited by sufficient voltage. The design shown above is only one possible design intended merely to exemplify the invention. The substrate on which the electrodes are patterned is preferably a flexible insulating material such as polyimide (Kapton™) but could also be a rigid material such as glass.

In one preferred embodiment, the electrodes are coated with a moderately oleophobic (low surface energy) material, such as DuPont Teflon-AF™ having surface tension of 18 dynes/cm or Cytop™, made by Asahi Glass and having surface tension of 19 dynes/cm. Probably the most effective group of such coatings is the fluoropolymers, more specifically amorphous Perfluoropolymers. Most fluoropolymers, including PTFE, FEP, PFA, PVDF, and/or PTFE, have suitably low surface energy and make good coating materials because they have the desired electrical properties, namely, high dielectric breakdown strength (>50 MV/m) and high volume resistively (>1e14 ohm-cm).

The volumetric flow rate calculated per electrode pair shows the wide range attainable, from 1 pL to 10 nL per second, as a function of voltage.

This liquid DEP has been used in conjunction with the fluid flow system and method. One preferred embodiment uses "co-planar" aluminum electrodes that are essentially flat to the surface and that are patterned using conventional photolithography on glass substrates for this microactuation scheme. The electrode width is 90 um and the gap is 30 um. For an individual experiment, a 1-10 μL droplet of insulating oil is dispensed at the T-junction of the electrode pair as depicted in FIG. 3*c*.

The electrodes are coated with a low surface energy, non-conducting material 44 (shown in FIG. 3*b*). The insulating oil has very low surface energy that causes it to spread over glass in an uncontrolled manner. An appropriate oleophobic surface coating is required with low surface energy that will make the oil drop bead up, thereby minimizing droplet spreading. Proper surface coatings that promote the pinning of the oil finger along its edges once it emerges from the parent droplet is critical to maintaining flow control. Good results are attained with Teflon-AF and Cytop™. These materials have comparable dielectric constants (~2.1) but the breakdown strength of Cytop™ is five times higher than Teflon-AF.

Factors Influencing the Flow

There are three important parameters that control the flow of the oil. First and foremost, the liquid viscosity determines actuation speed and maximum flow rates. A high viscosity silicone oil, for example 350 centistoke (manufactured by Dow Corning), requires very high voltage (>1.5 kV) and exhibits very sluggish flow. On the other hand, for lower viscosity oils, for example, 50 centistoke, higher flow rates can be achieved at lower voltages. Second, the applied voltage controls actuation speed. The higher the magnitude of voltage is, the faster the liquid finger moves. Voltage also controls the cross sectional profile of the liquid finger. A lower voltage will confine the finger between the inner edges of the electrodes. When the voltage is increased, the cross-section expands laterally to cover the entire width of the electrode structure, thereby, increasing the flow of the liquid. Third, the electrode geometry influences the flow. From experimental tests, it is found that an electrode width to gap ratio of 3:1 is optimal.

The flow control scheme has two regimes: (i) voltage on, with the oil controlled by the DEP force and (ii) voltage off, with the oil controlled by capillarity. FIGS. 4, 5, and 6 show a collection of frames depicting the actuation scheme. In FIG. 4, frame (1) shows a parent drop of 50 centistoke silicone oil residing at the T-junction of the electrodes before applied voltage. When sufficient voltage is applied, at time, t=~1.2 sec, a liquid finger emerges from the droplet and starts to travel along the length of the structure as shown in frame (2). Frame (3) and (4) show the subsequent forward progress of the finger as time is increased to ~4.7 sec. At t=22 sec, the liquid finger reached the end of the structure.

FIG. 5 is a sequence of video frames that show the rupture of the rivulet when the voltage is removed. In frame (1), the intact rivulet extends to the end of the electrode structure, held in a stable configuration by the non-uniform electric field lines. When the voltage is turned off, the finger starts to retract due to capillary instability (frame 2), but at the same time multiple droplets form due to capillary instability (frames 3-7). Due to the limited field of view of the microscope, the camera has been panned left to right to capture the phenomenon. Frame (7) shows multiple droplets equidistant from each other. Once the structure has been primed by droplets, in an initial time frame typically between 0.1 to 10 seconds (depending on viscosity and applied voltage), electric-field and capillarity assisted on/off control mechanism can be utilized at a much faster rate. The response time of the droplets to reform the finger is much shorter than the initial time to create the droplets. FIG. 6 is an illustration of this valve-like operation. FIG. 6(*a*) shows the initial droplets sitting atop the electrode structure. When the voltage is reapplied, the droplets recombine to form a rivuletas shown in FIG. 6(*b*).

Figure 8A:
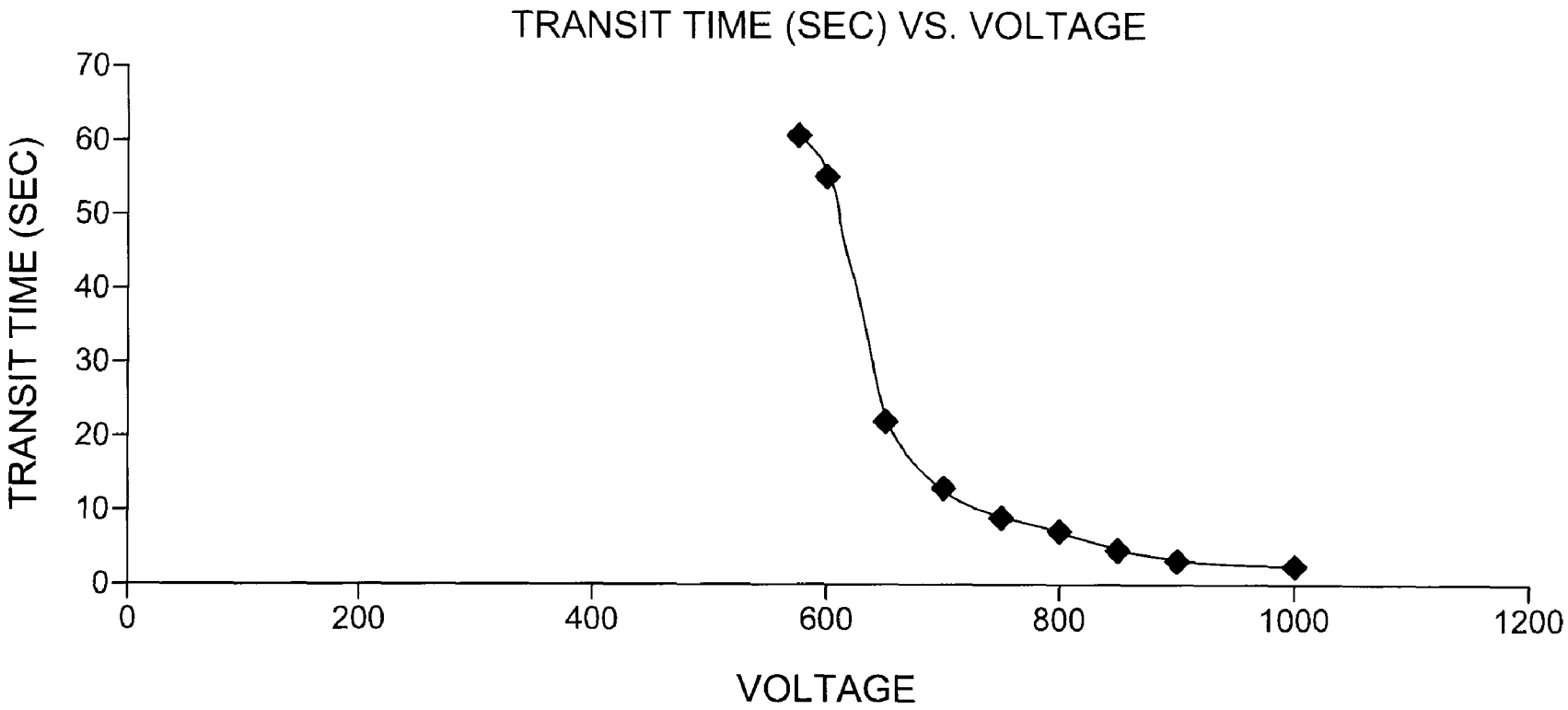
FIGS. 8*a*, 8*b* and 8*c* show the results of using the fluid movement system according to one aspect of the invention.
Figure 8B:
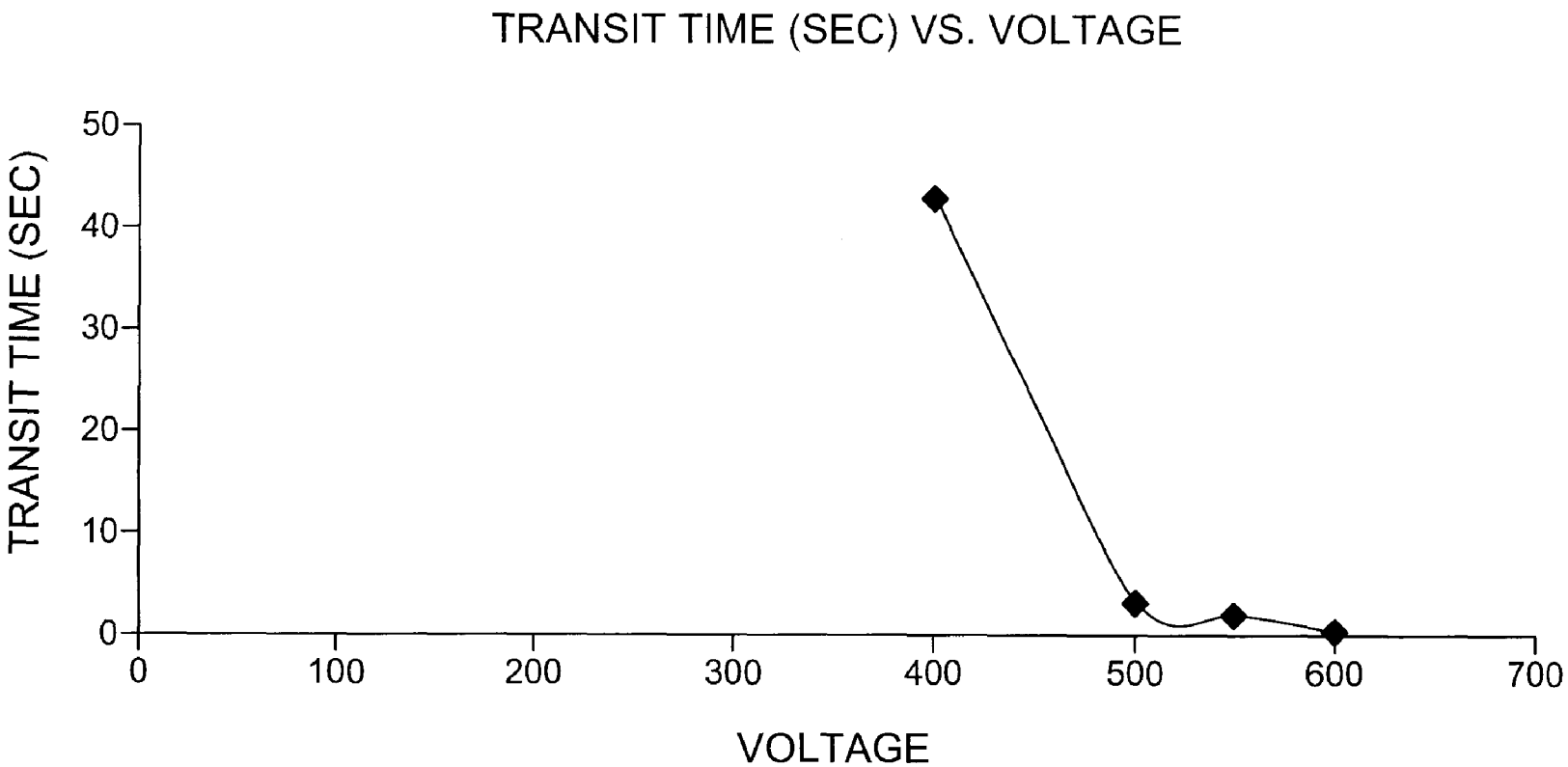
Figure 8C:
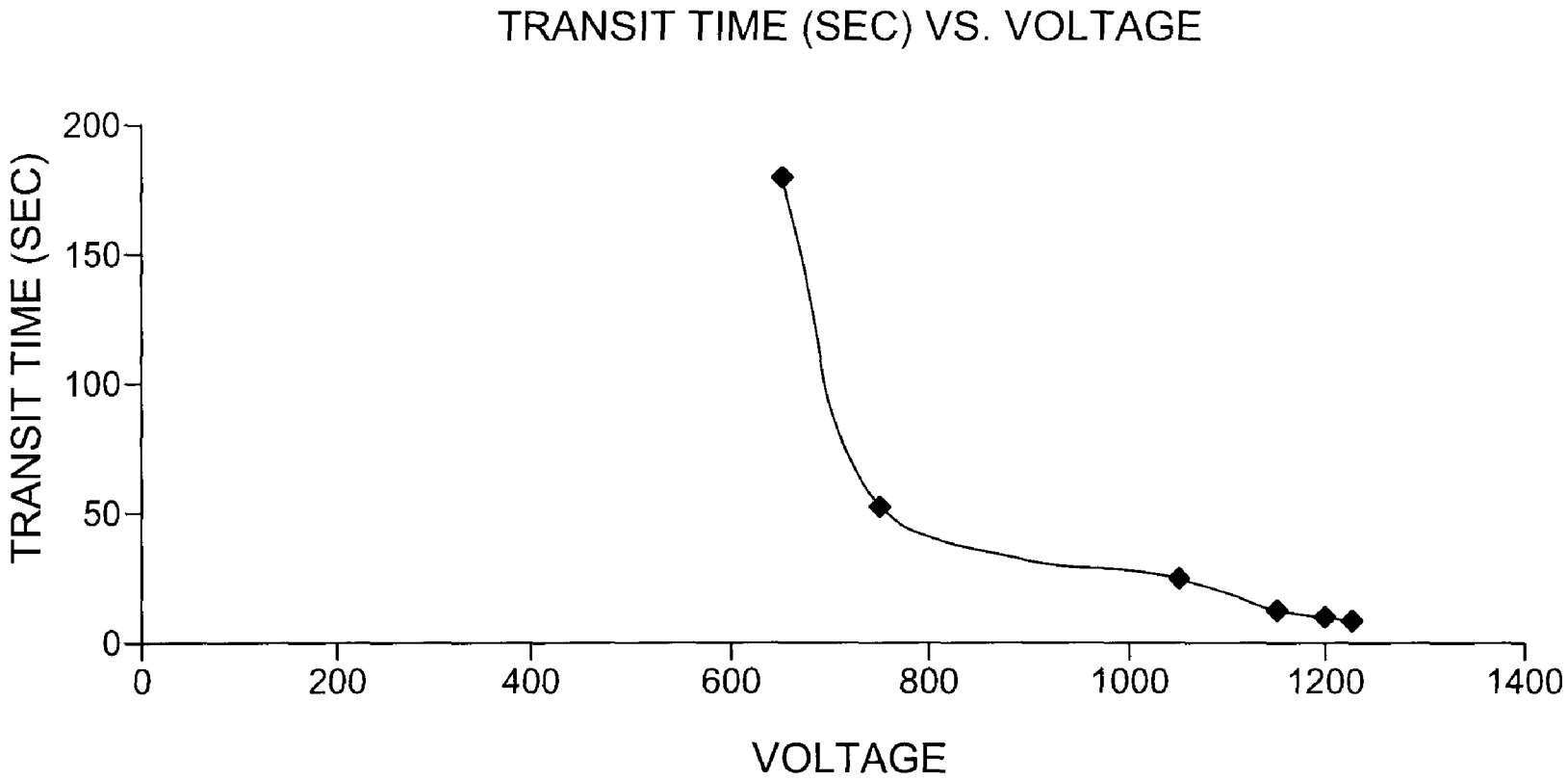

The transit time for initial priming of the liquid finger was recorded as a function of voltage for three viscosity grades of silicone oil: 3, 50, and 350 centistokes. FIGS. 8*a, b,* and *c* plot these transit time data. Each viscosity grade has a threshold voltage below which the finger will not travel the entire distance of 5 mm. This threshold value, $V_{threshold}$ can be determined experimentally. For 50 cst oil, $V_{threshold}$ is 575 V-rms. At this voltage, it takes ~61 seconds for the finger to emerge from the droplet and reach the end of the structure. Increasing the voltage from 575 to 600 decreases the time from 61 sec to 55 sec. If the voltage is increased from 600 to 650, there is a drastic reduction in the transit time to ~22 seconds. When the voltage is increased to 1000 V-rms, the transit time drops to ~2 seconds.

Cross-Sectional Profile as a Function of Voltage

Once the finger reaches the end of the structure, the flow ceases unless the oil is removed, as will be the case in the preferred embodiment discussed above. Here, oil is being continuously applied to the fuser roll of a printer. In order to determine the volumetric flow rate in the DEP flow structure under these conditions, a paper blotter is weighed and then mounted at the end of the structure. Voltage is applied to the electrodes and liquid flows to the blotter until the initial liquid droplet as been entirely absorbed, at which time the voltage is removed. The volumetric flow rate is then determined by weighing the blotter again, subtracting the tare weight, and dividing this mass by the product of the lapsed time and the mass density of the oil. Data are provided in Table A below.

TABLE A

Steady-state volumetric flow rate as a function of voltage results:

| Voltage | per electrode pair | per cm of electrode array | per page (8.5" × 11") |
|---|---|---|---|
| 675 V | 29 pl/s | 2.4 nl/s | 60 nl/page |
| 800 V | 1 nl/s | 83 nl/s | 1.5 μl/page |
| 900 V | 3 nl/s | 250 nl/s | 4 μl/page |

These rates are average rates over the 6 mm.

Figure 9:
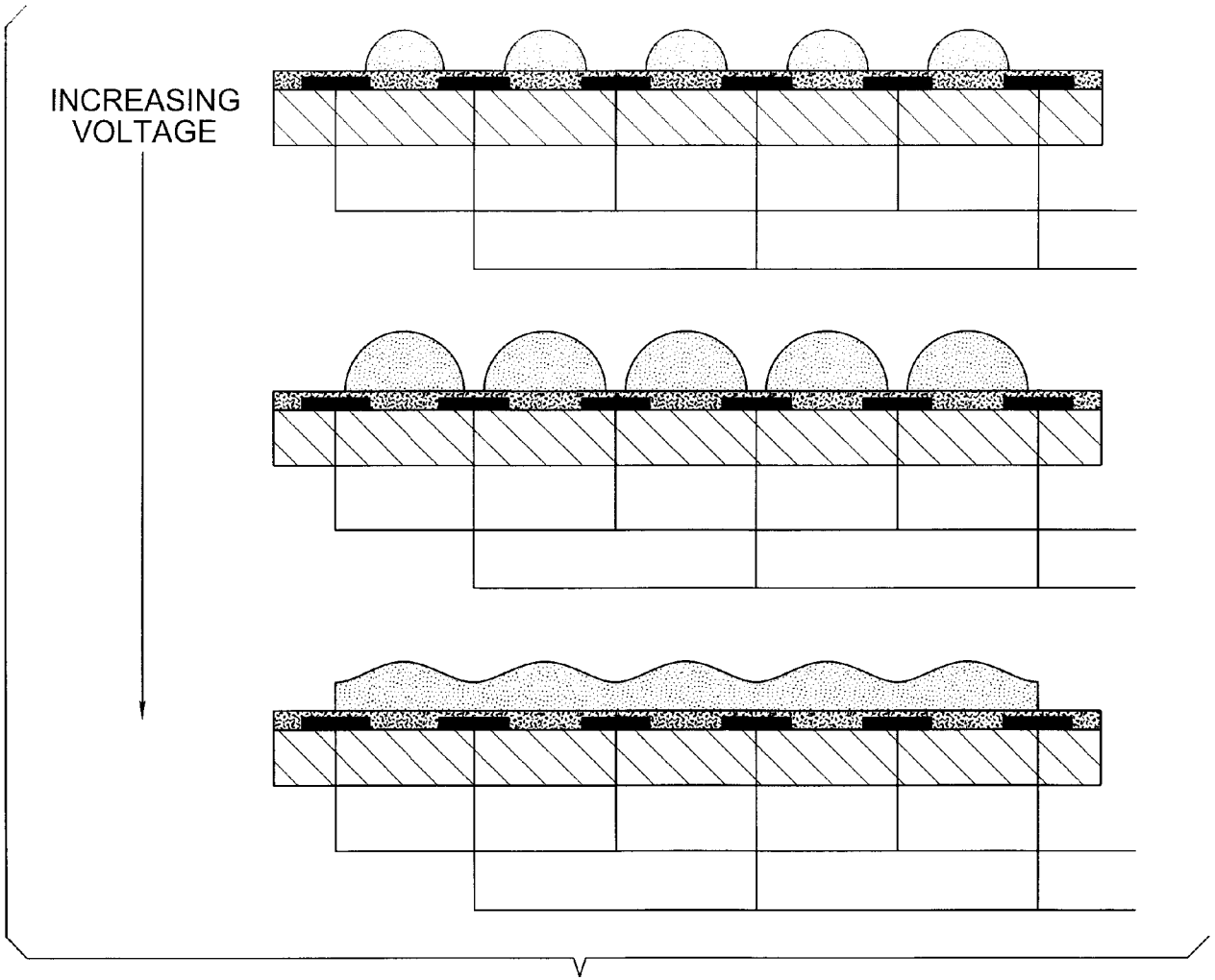
FIG. 9 shows the results of using the fluid movement system according to one aspect of the invention.

The steady state volumetric flow rate is a strong function of the applied voltage. As mentioned previously, increasing the voltage increases the cross-sectional profile of the finger and therefore the hydraulic diameter. FIG. 9 shows how changing the voltage affects the cross-sectional shape of the finger.

The first frame of FIG. 9 shows that at 675 V-rms, which is slightly above the threshold voltage value, the finger is confined within the inner edges of the electrodes. Once the voltage is increased to 800 V-rms (second frame), the liquid finger has a much fuller profile evidenced by the partial overlap on both electrodes as shown. Finally, when the applied voltage is 900 V-rms (third frame), the finger spans across the outer edges of both electrodes. The volumetric flow rate at 675 V-rms is approximately 29 picoliters/second. When the voltage is increased to 800 V-rms, the flow rate increases to 1 nanoliter/second. Finally, at 900 V-rms, the flow rate is about 3 nanoliters/second. These flow rates are based on a single pair of electrodes. These results indicate that simply increasing the voltage by a factor of approximately two makes it possible to control the volumetric flow rate by 3 orders of magnitude. This wide range of flow rates will be very useful in printers, where it is desirable to control the amount of oil dispensed to the fuser roll in time and space, depending on the size of the page and the amount and location of solid color area on each page of a document.

Preferred Power Supply

The electric power source 16 is preferably an alternating current (AC) with a frequency greater than 5 Hz but it could range from 50 Hz-100 KHz and could be a DC power source. The waveform of the AC power source can be a sinusoid, square, saw tooth or any other shape, but is preferably a square wave. The duty cycle of the waveform is not restricted but 50% is preferred.

The invention has been described in detail with particular reference to certain preferred embodiments thereof, but it will be understood that variations and modifications can be effected within the spirit and scope of the invention.

The invention claimed is:

1. A coating system for delivering non-conductive liquid onto a roller, comprising:

a) a reservoir spaced from the roller for holding the non-conductive liquid;

b) a microfludic structure including:

i) at least two substantially parallel, spaced-apart microelectrodes, each having one end positioned in non-conductive liquid in the reservoir and the other end extending towards a surface of the roller; and ii) a non-conducting surface supporting the at least two substantially parallel, spaced-apart microelectrodes, the surface having one end positioned in the liquid in the reservoir and the other end positioned adjacent to the surface of the roller; and c) an electric power source connected to the at least two substantially parallel, spaced-apart microelectrodes for supplying electric power to the microelectrodes so that a non-uniform electric field is produced that draws non-conductive liquid in the reservoir across the non-conducting surface, parallel to the at least two substantially parallel, spaced-apart microelectrodes, towards the roller and delivers the drawn non-conductive liquid to the surface of the roller.

2. The system of claim 1, wherein the at least two substantially parallel, spaced-apart microelectrodes are coplanar.

3. The system of claim 1, wherein the respective ratios between the spacing between the at least two substantially parallel, spaced-apart microelectrodes and the respective widths of the at least two substantially parallel, spaced apart microelectrodes are between 2:1 and 3:1.

4. The system of claim 1, wherein the at least two substantially parallel, spaced-apart microelectrodes have a non-conducting coating.

5. The system of claim 4, wherein the dielectric breakdown strength of the non-conducting coating is greater than 50 Volts/micron.

6. The system of claim 1, wherein the non-conductive liquid is a polymer that hardens when cooled or dried.

7. The system of claim 1, wherein the non-conductive liquid is a polymer dissolved in a solvent.

8. The system of claim 7, wherein the non-conductive liquid is a polymer that hardens when cooled or dried.

9. The system of claim 1, wherein the non-conductive liquid comprises a group including dyes and particles.

10. The system of claim 1, wherein the non-conductive liquid is an oil from a group of silicon mineral oils.

11. The system of claim 1, wherein the non-conductive liquid has resistivity greater than $1\times10^{10}$ ohm-cm.

12. The system of claim 1, wherein the non-conducting surface and the at least two substantially parallel, spaced-apart microelectrodes are coated with a material having a low surface energy so that the contact angle of the non-conductive liquid is greater than 10 degrees.

13. The system of claim 12, wherein the at least two substantially parallel, spaced-apart microelectrodes are 30 μm (micron) wide and 0.1 μm (micron) thick and the material is coated to a thickness of 0.5 μm.

14. The system of claim 1, wherein the non-conducting surface and the at least two substantially parallel, spaced-apart microelectrodes are coated with a material with a surface energy less than the surface energy of the non-conductive liquid.

15. The system of claim 1, wherein the non-conducting surface and the the at least two substantially parallel, spaced-apart microelectrodes are coated with a material such that the contact angle of the non-conductive liquid is greater than 10 degrees.

16. The system of claim 1, wherein the non-conducting surface and the at least two substantially parallel, spaced-apart microelectrodes are coated with a material such that the contact angle of the non-conductive liquid is greater than 50 degrees.

17. The system of claim 1, wherein the at least two substantially parallel, spaced-apart microelectrodes are spaced at a distance less than 0.1 mm.

18. The system of claim 1, wherein the at least two substantially parallel, spaced-apart microelectrodes are less than 1 μm thick or less than 1 mm wide.

19. The system of claim 1, wherein the at least two substantially parallel, spaced-apart microelectrodes are spaced at a distance between 60-90 μm (micron).

20. The system of claim 1, wherein the non-conductive liquid has a resistivity of greater than $1\times10^5$ ohm-cm.

21. The system of claim 1, wherein the electric power comprises alternating current (AC) with a frequency greater than 5 Hz.

22. The system of claim 1, wherein the electric power comprises alternating current (AC) with a frequency in the range 50 Hz-100 KHz.

23. The system of claim 1, wherein the electric power comprises direct current (DC).

24. The system of claim 1, wherein the non-conductive liquid has resistivity greater than $1\times10^{13}$ ohm-cm.

25. The system according to claim 1, wherein the roller is a fuser roller.

26. The system according to claim 1, wherein the at least two substantially parallel, spaced-apart microelectrodes include a plurality of substantially parallel, spaced-apart microelectrodes in a first array and a separate plurality of substantially parallel, spaced-apart microelectrodes in a second array, and the substantially parallel, spaced-apart microelectrodes of the first array are positioned between, and alternating with, the substantially parallel, spaced-apart microelectrodes of the second array.

27. A coating system for delivering non-conductive liquid onto a flexible support, comprising:

a) a reservoir spaced from the flexible support for holding the non-conductive liquid;

b) a microfludic structure including:

i) at least two substantially parallel, spaced-apart microelectrodes, each having one end positioned in the non-conductive liquid in the reservoir and the other end extending towards a surface of the flexible support; and ii) a non-conducting surface supporting the at least two substantially parallel, spaced-apart microelectrodes, the surface having one end positioned in the non-conductive liquid in the reservoir and the other end positioned adjacent to the surface of the flexible support; and c) an electric power source connected to the at least two substantially parallel, spaced-apart microelectrodes for supplying electric power to the at least two substantially parallel, spaced-apart microelectrodes so that a non-uniform electric field is produced that draws non-conductive liquid in the reservoir across the non-conducting surface, parallel to the at least two substantially parallel, spaced-apart microelectrodes, towards the flexible support and delivers the drawn non-conductive liquid to the surface of the flexible support.

* * * * *